US007998029B2

(12) United States Patent
Campbell

(10) Patent No.: US 7,998,029 B2
(45) Date of Patent: Aug. 16, 2011

(54) ARTICLE, ASSEMBLY AND METHOD FOR REHABILITATING CRANIAL (FACIAL AND NECK) MUSCLES

(76) Inventor: Mary E. Campbell, Detroit, MI (US)

( * ) Notice: Subject to any disclaimer, the term of this patent is extended or adjusted under 35 U.S.C. 154(b) by 0 days.

(21) Appl. No.: 12/632,869

(22) Filed: Dec. 8, 2009

(65) Prior Publication Data

US 2010/0151997 A1 Jun. 17, 2010

Related U.S. Application Data

(60) Provisional application No. 61/121,781, filed on Dec. 11, 2008.

(51) Int. Cl.
*A63B 21/00* (2006.01)

(52) U.S. Cl. ..... 482/11

(58) Field of Classification Search ..... 482/10, 482/11, 104–108, 124
See application file for complete search history.

(56) References Cited

U.S. PATENT DOCUMENTS

| | | | | |
|---|---|---|---|---|
| 3,820,780 | A | 6/1974 | Tarbox | |
| 4,189,141 | A | 2/1980 | Rooney | |
| 4,280,696 | A | 7/1981 | Ramon | |
| 4,641,826 | A * | 2/1987 | van der Weide | 271/18.3 |
| 4,666,148 | A | 5/1987 | Crawford | |
| 4,744,556 | A | 5/1988 | Shaffer | |
| 4,823,778 | A | 4/1989 | Ewing | |
| 4,832,333 | A | 5/1989 | Lockett | |
| 4,841,954 | A | 6/1989 | Kalsi | |
| 4,944,509 | A * | 7/1990 | Snider | 482/105 |
| 5,169,372 | A | 12/1992 | Tecco | |
| 5,192,254 | A | 3/1993 | Young | |
| 5,484,359 | A | 1/1996 | Wabafiyebazu | |
| 5,501,646 | A | 3/1996 | Miller | |
| 5,556,357 | A | 9/1996 | Hanna | |
| 5,588,940 | A * | 12/1996 | Price et al. | 482/105 |
| 5,728,028 | A | 3/1998 | Dusch | |
| 6,039,710 | A | 3/2000 | Kelley et al. | |
| 6,152,857 | A | 11/2000 | Gonzalez-Leal et al. | |
| 6,179,747 | B1 | 1/2001 | Kelley | |
| 6,248,043 | B1 | 6/2001 | Morton | |
| 6,277,053 | B1 | 8/2001 | Desembrana | |
| 6,406,405 | B1 | 6/2002 | Chu | |
| 7,101,314 | B1 | 9/2006 | Wang | |
| 7,134,986 | B2 | 11/2006 | Tiberio | |
| D535,711 | S | 1/2007 | Wang | |
| 7,238,144 | B2 | 7/2007 | Ferrara | |
| 7,384,377 | B2 | 6/2008 | Berman | |
| 7,462,132 | B2 * | 12/2008 | Kuehne | 482/11 |
| 2003/0073542 | A1 | 4/2003 | Patton | |
| 2005/0065000 | A1 * | 3/2005 | Reinhart | 482/105 |

* cited by examiner

*Primary Examiner* — Jerome W Donnelly
(74) *Attorney, Agent, or Firm* — Gifford, Krass, Sprinkle, Anderson & Citkowski, P.C.

(57) ABSTRACT

A patient supporting rehabilitating article for providing muscle restoration or restructuring and which includes a body and at least one weighted object arranged upon the body and being positioned at patient specific location during bi-direction repetitive movement initiated by the patient. The body in one variant includes a patient gripping handle terminating in a head support portion exhibiting an ergonomic configured underside. In another variant, the body exhibits a likewise ergonomically configured support portion with opposite attachment ends for receiving opposing looped ends associated with a patient wearable strap.

2 Claims, 5 Drawing Sheets

ARTICLE, ASSEMBLY AND METHOD FOR REHABILITATING CRANIAL (FACIAL AND NECK) MUSCLES

CROSS-REFERENCE TO RELATED APPLICATIONS

This Application claims the benefit of U.S. Provisional Application 61/121,781 filed on Dec. 11, 2008.

FIELD OF THE INVENTION

The present invention discloses an article, assembly and method for providing facial, neck and cranial restoration or restructuring without surgical incisions, this being accomplished through the placement of weights mounted to a resistance/adhesive tape, Velcro strap or the like. The weights are mounted in a counterbalancing fashion at a location above a pivotal-balancing point in the neck. In one specific variant, precision weights are designed for use in rehabilitating facial muscles. An exercise routine associated with the secured/suspended weights assists in rehabilitation of such as the forehead (epicranis or broad scalp muscles), occipitailis and frontailis (eyebrow muscles), lips, jowls and other facial or neck muscles, and which serves to promote facial restructuring without the requirement of incisive surgical procedures.

BACKGROUND OF THE INVENTION

The prior art is well documented with examples of rehabilitative devices and assemblies, such as for use with various muscle groups associated with a user's face and the like. One example is disclosed in the facial exercise method of Ewing, U.S. Pat. No. 4,823,778 and which teaches a method for exercising facial muscles for the purpose of tightening the wearer's skin. A primary stiffener is applied by adhesion to the surface of the skin adjacent a selected muscle, with secondary stiffeners applied to other regions of the skin which might be creased by contraction of the selected muscle. A weight is attached to the primary stiffener and the selected muscle is exercised to repeatedly lift and lower the weight in a controlled manner.

Both U.S. Pat. Nos. 7,101,314 and D535,7811, to Wang, teach steel-bead weighted facial exercise weights designed to be placed over the face providing resistance against an intended group of facial muscles to be developed. Rooney, U.S. Pat. No. 4,189,141 teaches a facial exercise mask including an externally convex mask body constructed of an elastic two-way stretch cloth material. Weights are enclosed in pockets secured inside the mask at various eyebrow, temple, cheek, nose and chin locations. The mask is further held in place by separate, adjustable head and chin straps, or by a single wide elastic strap engaging the back of the wearer's head.

SUMMARY OF THE INVENTION

A patient supporting rehabilitating article for providing muscle restoration or restructuring and which includes a body and at least one weighted object arranged upon the body and being positioned at patient specific location during bi-direction repetitive movement initiated by the patient. The body in one variant includes a patient gripping handle terminating in a head support portion exhibiting an ergonomic configured underside. In another variant, the body exhibits a likewise ergonomically configured support portion with opposite attachment ends for receiving opposing looped ends associated with a patient wearable strap.

Additional features include a threaded shaft projecting upwardly from a support portion associated with the body, with the weighted object further including a plurality of individual weighted washers stackably engaged around the shaft. The support portion may also exhibit a generally disk shaped support outline for supporting the individual stackable weights, and a wing nut may be threadably attached to the shaft over an uppermost stacked and weighted washer. In a yet further variant, a pair of weights can be located in side-by-side disposed fashion upon the body which includes a continuous extending strap.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

The present invention discloses an article, assembly and method for providing facial, neck and cranial restoration or restructuring without surgical incisions, this being accomplished through the placement of weights at strategic locations which are mounted to a resistance/adhesive tape, Velcro strap or the like. The weights are mounted in a counterbalancing fashion at a location above a pivotal-balancing point in the neck and, as will be subsequently described, provide for repetitive training by the user according to a number of different rehabilitating exercises.

In one specific variant, precision weights are designed for use in rehabilitating facial muscles. An exercise routine associated with the secured/suspended weights assists in rehabilitation of such as the forehead (epicranis or broad scalp muscles), occipitailis and frontailis (eyebrow muscles), lips, jowls and other facial or neck muscles, and which serves to promote facial restructuring without the requirement of incisive surgical procedures.

Figure 10:
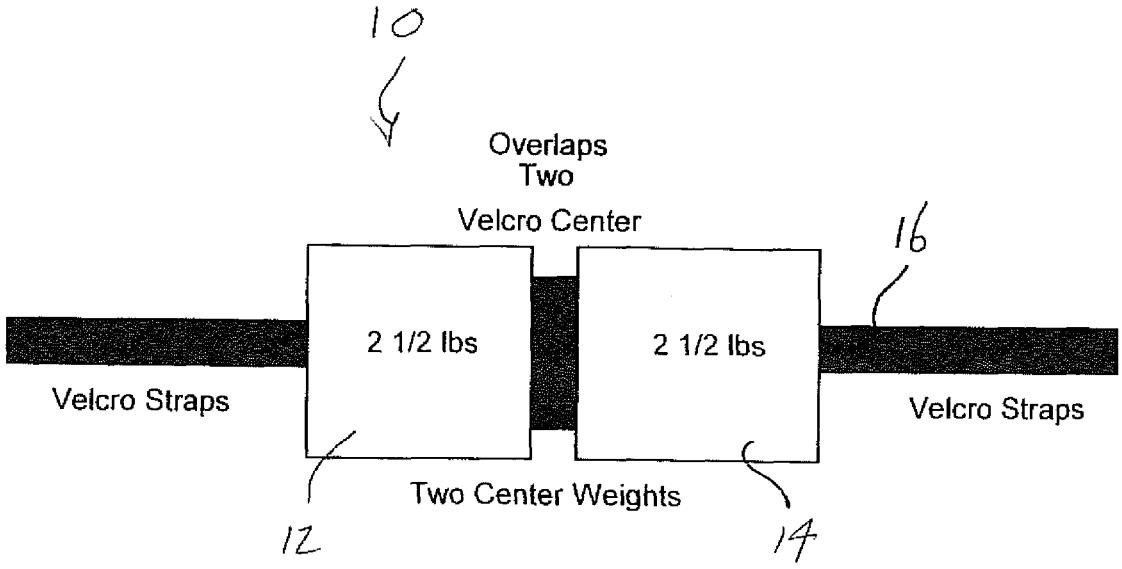
FIG. 10 is an illustration of a yet further variant of the present invention and which includes a pair of center weights secured to such as a Velcro® or other suitable belt or hook and loop fastener, and such as which can be wrapped about a wearer's head for securely positioning the weights for repetitive training in a "heads up" routine.

Referring first to FIG. 10, an illustration is shown at 10 of one variant of the present invention, this including a pair of center weights 12 and 14 (such as in the illustrated embodiment being 2½ lbs apiece). The weights are secured to such as a Velcro® strap, or other suitable belt or hook and loop fastener as shown at 16, and such that the weights can be wrapped about a wearer's head for securely positioning for repetitive training according to a "heads up" routine.

According to one preferred application, six separate pieces are provided, such as described above. In the preferred application, each of the individual (center) pieces corresponds to a (Velcro) strap exhibiting dimension measurements of 10¼" by 2" (although other strap dimensions and constructions can be substituted without departing from the scope of the invention), and upon which the center weights are secured. The weights 12 and 14 can each be a one-piece solid however, and in a desired application, are provided a multiple beads sewn within a cloth or fabric casing and so that they provide a maximum degree of ergonomic comfort.

The cloth component of the present design is preferably non allergic and comfortable to the skin, including being color safe (such as in response to washing) and providing some degree of stretch. Additional components used with the device can include a hypoallergenic and non-latex tape, this extending 1" across (e.g. length is contoured to wearer's face at time of application) and is used to control muscles when necessary.

The nature of the Velcro (or releasable hook and loop) fasteners is further such that the additional straps (such as exhibiting 1¼" dimensions) can support the individual weighted portions, this in order to selectively decrease (e.g. to 2½ lbs) or increase (to 5 lbs) the overall supported weight. In this fashion, varied weight placement is made possible, this including adjustments such as associated with repetitive exercise training of the cranial muscles. The center pieces can exhibit a total length of 14¼" by 2", as connected with overlap Velcro between the center pieces, further providing for ¼" seam allowance.

Rehabilitating (training) methods associated with the present design include applying such as a center weight upon the users lips, following which "pucker up" (pout, whistle like) motions are established in very small but intense movements, thereby creating resistance in the mouth and jowls area. This weight training exercise becomes progressively more difficult as the number of repetitions increases, in turn resulting in more intense engagement of the muscles, in turn resulting in increase in lip size, with additional defining of jaw line (i.e. reduction of fatty jowl facial profile). It is noted that up to six exercises can be provided which utilize the muscle group in the mouth area, with the pucker up movement requiring in particular one consistent and intense movement for strengthening and toning the lower jaw and lip area.

Figure 1:
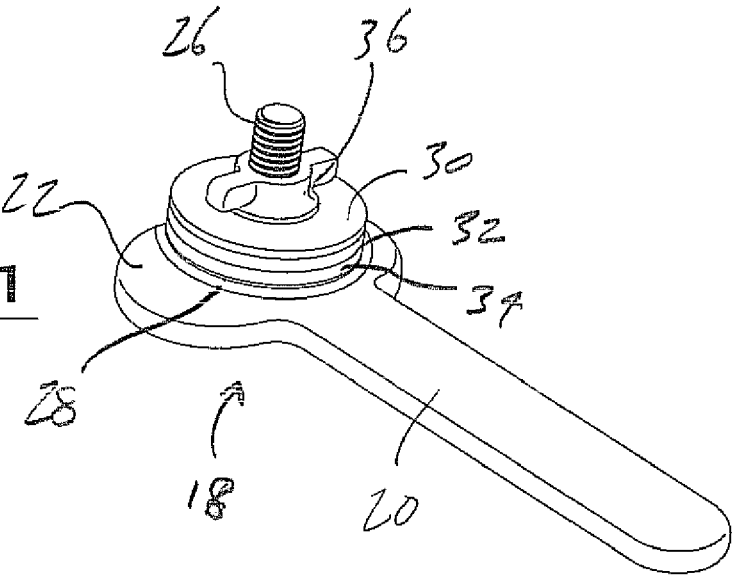
FIG. 1 is a perspective illustration of a weight supporting and hand held tool for use in developing/rehabilitating muscles of the lip and upper jaw according to one embodiment.

FIG. 1 is a perspective illustration, generally shown at 18, of a weight supporting and hand held tool for use in developing/rehabilitating muscles of the lip and upper jaw according to one embodiment. As further illustrated in each of the succeeding views of FIGS. 2-5, the tool 19 includes a hand gripping handle 20 terminating at a forward end in a generally arcuate profile shaped weight supporting head portion 22. As further shown in FIG. 3, a rotated underside perspective of the tool 18 illustrates an ergonomic configuration 24 (such as an aruate recess) associated with weight supporting head portion 22 and which facilitates location and contact upon a user's lips 2 and 4 (see FIGS. 4 and 5).

Figure 2:
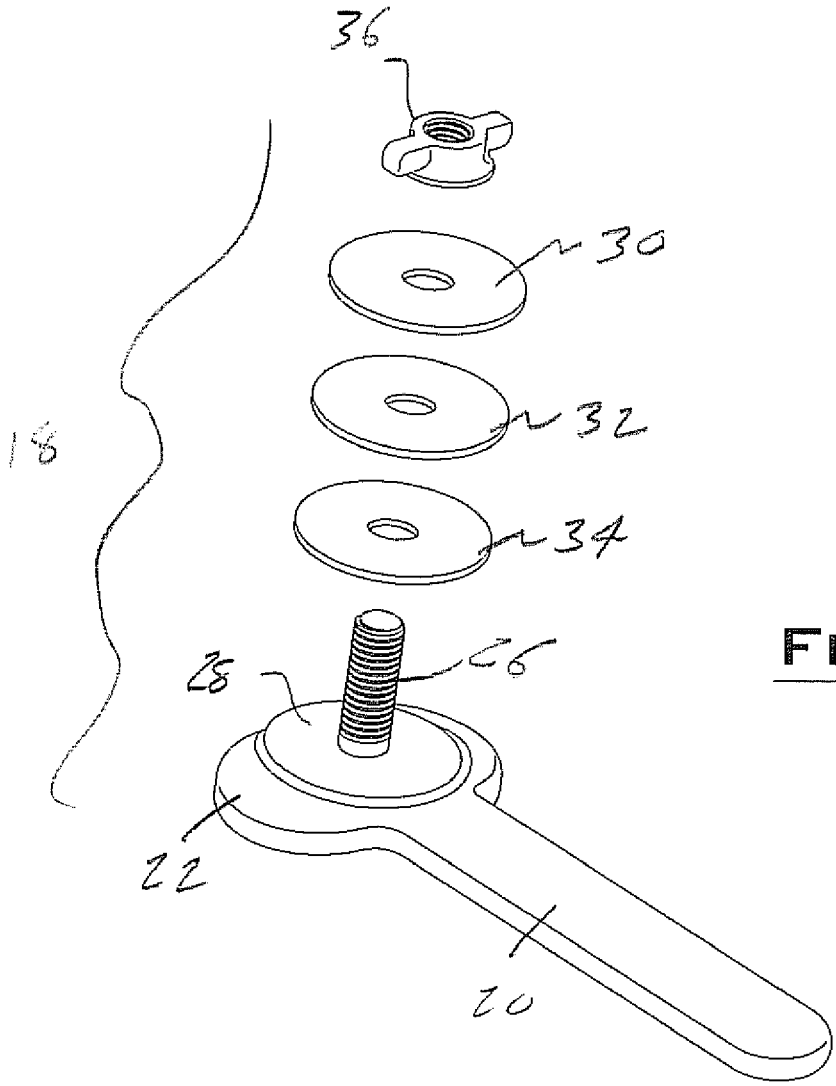
FIG. 2 is an exploded view of the tool as shown in FIG. 1 and illustrating the stackability factor associated with the plural weights.
Figure 3:
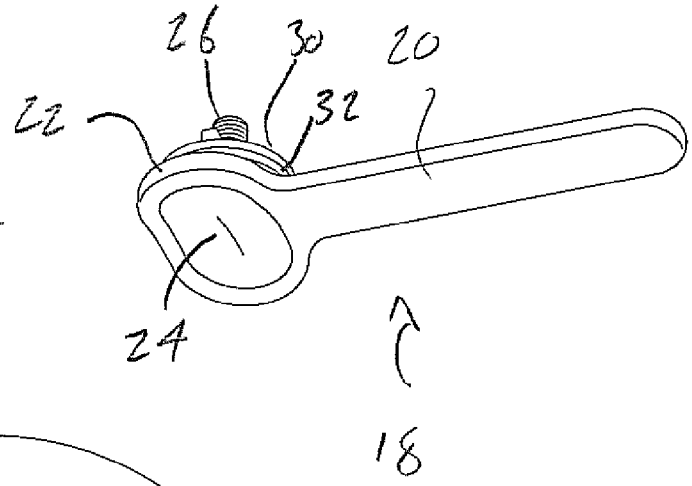
FIG. 3 is a rotated underside perspective illustrating the ergonomic configuration associated with weight supporting head portion of the hand held tool.

As best shown in the exploded view of FIG. 2, a threaded shaft or fastener 26 extends upwardly from a generally disk shaped support outline 28, this in turn providing seating support for any plurality of individual weighted washer shaped elements 30, 32, 34, et seq. which are stackingly engaged around the fastener 26. The washer shaped weighted elements can exhibit any desired individual weight (such as determined by any suitable scale measured in grams or ounces) and it is further envisioned that these can also exhibit either equal or differing weights. A wing nut 36 is also provided and threadably attaches to the fastener 26 over an uppermost stacked and weighted washer 30 to secure the stacked arrangement during use.

Figure 4:
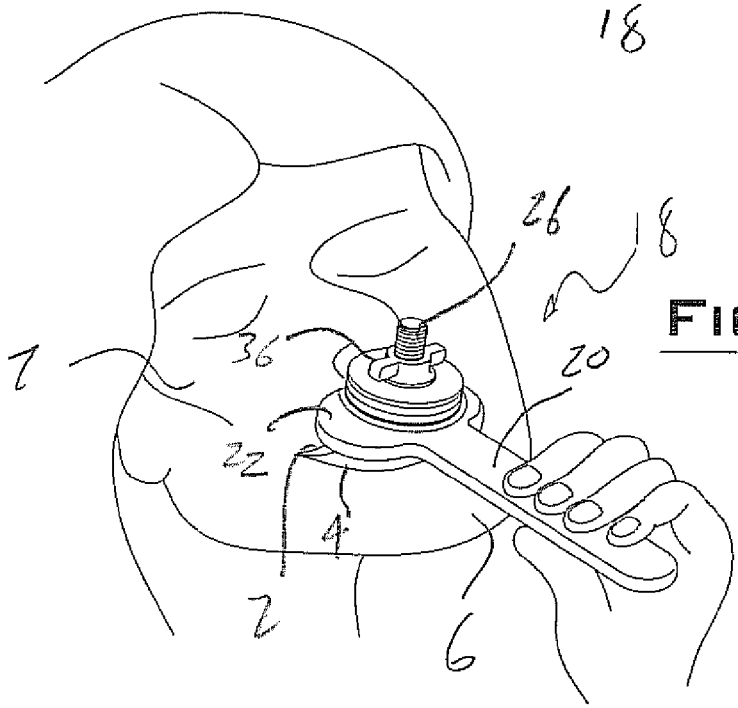
FIG. 4 is an environmental perspective view of the tool of FIG. 1 in use.
Figure 5:
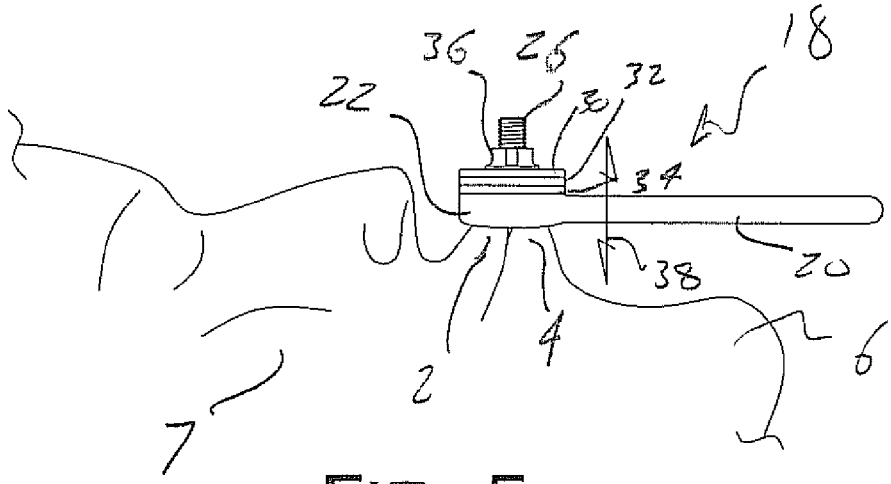
FIG. 5 is a side plan view of FIG. 4 and further illustrating the up/down repetitive exercising/rehabilitation motion of the tool.

FIGS. 4 and 5 are environmental perspective and side plan views of the tool of FIG. 1 in use. In particular, a repetitive up/down motion is evidenced by bi-directional arrow 38 and which, consistent with the previous description, facilitates repetitive exercising of the lips 2 and 4 as well as the jaw 6 and cheekbone 7.

A further rehabilitate training exercise can also include what is termed a "heads up" exercise, and in which the exerciser's platysma (chest-shoulder-chin) muscles are utilized along with the three auricularis muscles surrounding the ear, the temporalis muscle in the temple area, and the epicranus (broad scalp) or occipito-frontalis. The epicranus consists of both occipatalis (back) and frontalis (front), with the frontalis muscle raising the eyebrows, drawing the scalp forward and causing wrinkles across the forehead. The occipatalis and frontalis are connected by a tendon called the aponeurosis. Strategically placing the weights upon the above muscle groups is consistent with exercises for accentuating and toning the chin and jaw line, strengthening and firming the contours of the neck and back including the area behind the user's ear, lifting the forehead, eyebrows, and diminishing the furrows from between the eyes.

Figure 6:
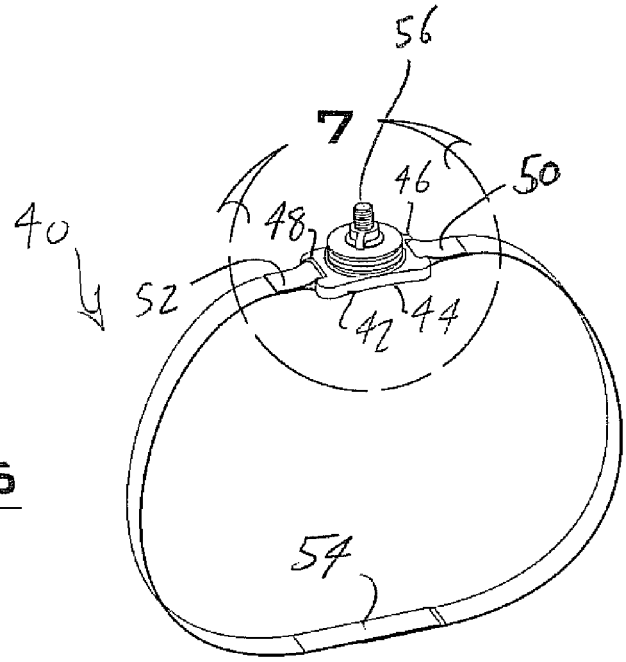
FIG. 6 is a perspective view of a tool according to a further variant adapted for exercising/rehabilitating the forehead and cranial muscles.
Figure 7:
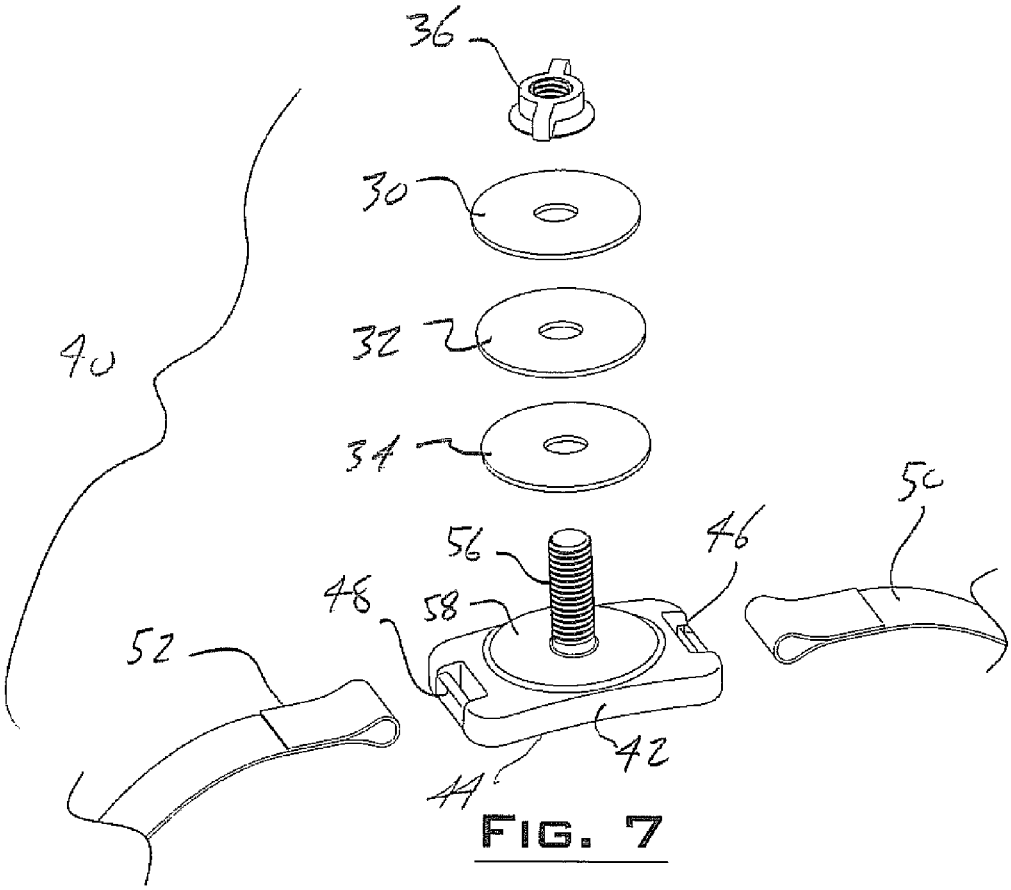
FIG. 7 is an exploded view of enlarged area 7 as shown in FIG. 6 of the forehead wearable tool.
Figure 8:
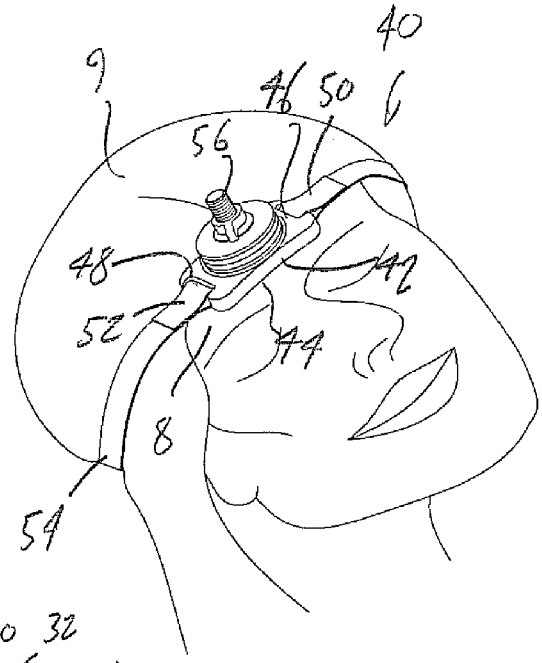
FIG. 8 is an environmental perspective of the tool of FIG. 6 in use.
Figure 9:
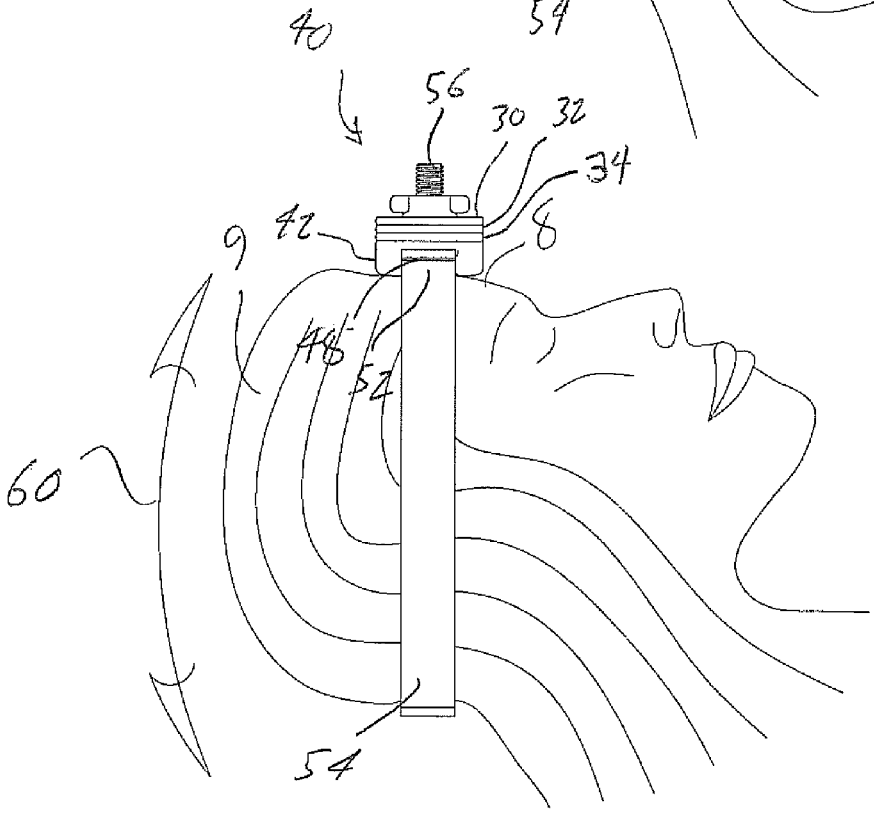
FIG. 9 is a side plan view of FIG. 8 and further illustrating the up/down repetitive motion of the forehead worn tool.

Consistent with this description, FIG. 6 is a perspective view, generally shown at 40, of a tool according to a further variant adapted for exercising/rehabilitating the forehead 8 and cranial 9 muscles (as illustrated in the environmental perspective and side plan illustrations of FIGS. 8 and 9). As further shown in FIG. 7, which is an exploded view of the forehead wearable tool of FIG. 6, an ergonomically configured support portion 42 is provided (and which is similar in some respects to a watch jewel case body or like structure).

Reference in particular is made to contoured underside 44 which is supported at a location upon a user's forehead (again FIG. 8) and, in combination with opposite attachment ends 46 and 48, receives opposing looped ends 50 and 52, respectively, associated with a strap or band 54 adapted for placement about the user's head and so that the configured support portion 42 is generally centrally positioned upon the wearer's forehead 8. Similar to the tool 18 shown in FIG. 1, a threaded fastener 56 extends upwardly from a generally disk shaped support outline 58 (again FIG. 7), this in turn providing seating support for any plurality of individual weighted washer shaped elements which are again illustrated at 30, 32, 34, et seq. and which can exhibit any desired individual weight (such as determined by any suitable scale measured in grams or ounces) and is again further envisioned that these can also exhibit either equal or differing weights. Wing nut 36 is again illustrated and threadably attaches to the fastener 56 over an uppermost stacked and weighted washer 30 to secure the stacked arrangement during use.

As again evidenced in each of environmental views of FIGS. 8 and 9, up/down repetitive motion of the forehead worn tool 40 is evidenced by bi-directional arrow 60 and exhibits a slightly arcuate profile corresponding to up/down lifting of the wearer's head using the neck muscles.

It is also understood that, for exercise routines such as these, an esthetician will need to apply a hypoallergenic (latex free) tape to secure the forehead area and between the eyes, this in order to avoid wrinkling between the eyes by the epicranus muscles. The "E-wing" exercise routine (this employing a metal disk, not shown, exhibiting a general weight and size of a penny) is placed between a pair of thin cardboard plates, and can be employed in up to sixteen different exercises to utilize substantially all of the muscles of the foreahead. The "heads up" protocol utilizes muscles of the forehead and neck (both front and back) in one exercise routine.

Additional exercise routines can include both the cheeks and under the eyelids, although care must be taken to avoid uneven facial response from one side relative to the other. This may require some degree of customization in order to "equal out" the protocol, including such as applying weights to only one side of the face or doubling the weights on the other side, such exercises being termed "cheek to cheek" or "peek a boo" eye area.

Body positions associated with the exercised protocol utilizing the present weighted article include the user first lying flat on his/her back. At this point, the 5 lb weight is placed on the forehead, with the Velcro straps wrapping around the head and securing the weight(s) in place. In an associated exercise protocol, and lying flat on the back, the user extends the head over the side (such as of a bed), then slowly lifting the head to shoulder height and back (to start position) in a slow deliberate fashion and without jerking. Such controlled movements contribute to an immediate sensation of head and neck contractions, although care should be taken to avoid excessive exertion associated with an increased number of repetitions with concomitant decreased time intervals.

The present invention therefore discloses a novel and useful (Neckti-System) article, assembly and method for providing facial, neck and cranial restoration or restructuring, again without the necessity of surgical incisions, and by which the neck provides the balancing point that executes all movement (up through the skull to the base of the neck), this in conjunction with precision applied weights which are designed specifically for the cranial muscles, as well as the use of resistant tape for isolating those muscles. The exercise protocols for utilizing the Neckti-System article further again contemplates providing for facial restoration activated through placement of weights/resistance tape, in combination with strategic movements for providing facial stimulation/resistance in order to build, strengthen, enhance, restore and define all muscles throughout the cranial system, this again without the use or need of surgical implements such as needles or scalpels.

Benefits associated with the present article, system and method include providing definition to the lip area, eliminating jowels around the mouth through strengthening of the caninus, mentalis, orbicularis, zygomaticus, quadratis labil superioris, quadratis labil inferior, buccinators, risorius, masseter and temporalis muscles that collectively comprise the mouth area and impacts the jaw line to assist in elevating the cheeks.

Having described my invention, other and additional preferred embodiments will become apparent to those skilled in the art to which it pertains, and without deviating from the scope of the appended claims.

I claim:

1. A patient supporting rehabilitating article for providing muscle restoration or restructuring, comprising:

a hand held body including a gripping handle terminating at a forward end in a generally arcuate shaped and weight supporting head portion including an ergonomic configured recessed underside, said body having a specific shape and size and adapted to being placed over a patients lips for exercising at least one of the lips and jaw;

at least one weighted object arranged upon said body and being positioned at patient specific location during bi-direction repetitive movement initiated by the patient; and a threaded shaft projecting upwardly from a support portion associated with said body, said weighted object further comprising a plurality of individual weighted washers stackably engaged around said shaft, said support portion further exhibiting a generally disk shaped outline.

2. The article as described in claim 1, further comprising a wing nut threadably attaching to said shaft over an uppermost stacked and weighted washer.

* * * * *